United States Patent [19]

Smart

[11] Patent Number: 4,714,010

[45] Date of Patent: Dec. 22, 1987

[54] INDUSTRIAL EXHAUST VENTILATION SYSTEM

[75] Inventor: W. James Smart, Newport Beach, Calif.

[73] Assignee: CM & E/California, Inc., Santa Ana, Calif.

[21] Appl. No.: 722,777

[22] Filed: Apr. 12, 1985

[51] Int. Cl.[4] ..... B05C 3/02; B08B 15/02

[52] U.S. Cl. ..... 98/115.4; 98/115.1; 118/425; 118/429; 118/DIG. 7; 134/76; 427/430.1

[58] Field of Search ..... 98/115.1, 115.4; 134/76, 82, 135, 26, 32; 118/425, 429, DIG. 7; 204/198; 427/430.1

[56] References Cited

U.S. PATENT DOCUMENTS

| | | | |
|---|---|---|---|
| 1,414,220 | 4/1922 | Singer | 134/76 |
| 1,896,951 | 2/1933 | Hahn | 98/115.1 |
| 2,772,523 | 12/1956 | Ruthner | 134/76 |
| 2,939,378 | 6/1960 | Zalkind | 98/115.4 |
| 2,970,351 | 2/1961 | Rice | 98/115.4 X |
| 3,106,927 | 10/1963 | Madwed | 134/76 |
| 3,205,810 | 9/1965 | Rosenak | 98/115.4 |
| 3,335,839 | 8/1967 | Neumann | 134/76 X |
| 3,444,802 | 5/1969 | Barton | 202/227 |
| 3,567,614 | 3/1971 | Vauriac | 98/115.4 X |
| 3,593,646 | 7/1971 | Hauville | 98/115.4 X |
| 3,631,791 | 1/1972 | Harris et al. | 98/115.4 |
| 3,913,470 | 10/1975 | Cullen | 98/115.4 |
| 4,015,945 | 4/1977 | Frankel | 98/115.1 X |
| 4,086,847 | 5/1978 | Overmyer | 98/115.4 |
| 4,087,333 | 5/1978 | Naevestad | 98/115.4 |
| 4,117,773 | 10/1978 | Johnson | 98/115.4 |
| 4,243,208 | 1/1981 | Laimer | 98/115.1 X |
| 4,346,058 | 8/1982 | Rigsby | 98/115.1 X |
| 4,389,923 | 6/1983 | Ludscheidt | 98/115.4 |
| 4,493,333 | 1/1985 | Layton | 134/82 X |

FOREIGN PATENT DOCUMENTS

| | | | |
|---|---|---|---|
| 2311600 | 12/1976 | France | 98/115.1 |
| 2541143 | 8/1984 | France | 98/115.4 |
| 2077419 | 12/1981 | United Kingdom . | |
| 709920 | 1/1980 | U.S.S.R. | 98/115.1 |

OTHER PUBLICATIONS

W. James Smart, "Energy Conservation Conversion of Existing Exhaust Ventilation Systems", prepared for Department of Navy; Apr. 27, 1982.

U.S. Navy Memorandum dated May 5, 1982, from L. J. Jones to Code 600.

U.S. Navy Memorandum dated Jan. 20, 1983, from J. M. Leland to Code 600, "Point Paper".

Hughes Helicopters, Inc., Purchase Order No. HH 245,100; Issue date: Apr. 18, 1984.

Hughes Helicopters, Inc., Purchase Order Change Notice, Purchase Order No. HH 245,199, Issue Date: Apr. 18, 1984.

*Primary Examiner*—Harold Joyce

*Attorney, Agent, or Firm*—Knobbe, Martens, Olson & Bear

[57] ABSTRACT

An industrial exhaust ventilation system enabling access to exhaust generating processes while containing and controlling the resultant exhausted gases is provided. A cover assembly is attached to the structure generating the exhaust gases and is provided with a reciprocating cover having an open and closed position. The exhaust generating process is accessible only when the cover is open. A conventional exhaust system is also provided to maintain the low level of air circulation necessary to convey the generated exhaust to a treatment facility. The ventilation system is optionally provided with a workload enclosure that travels to selected process structures and forms a fume containment region by interengaging with the cover assembly located thereon.

2 Claims, 14 Drawing Figures

Fig. 1
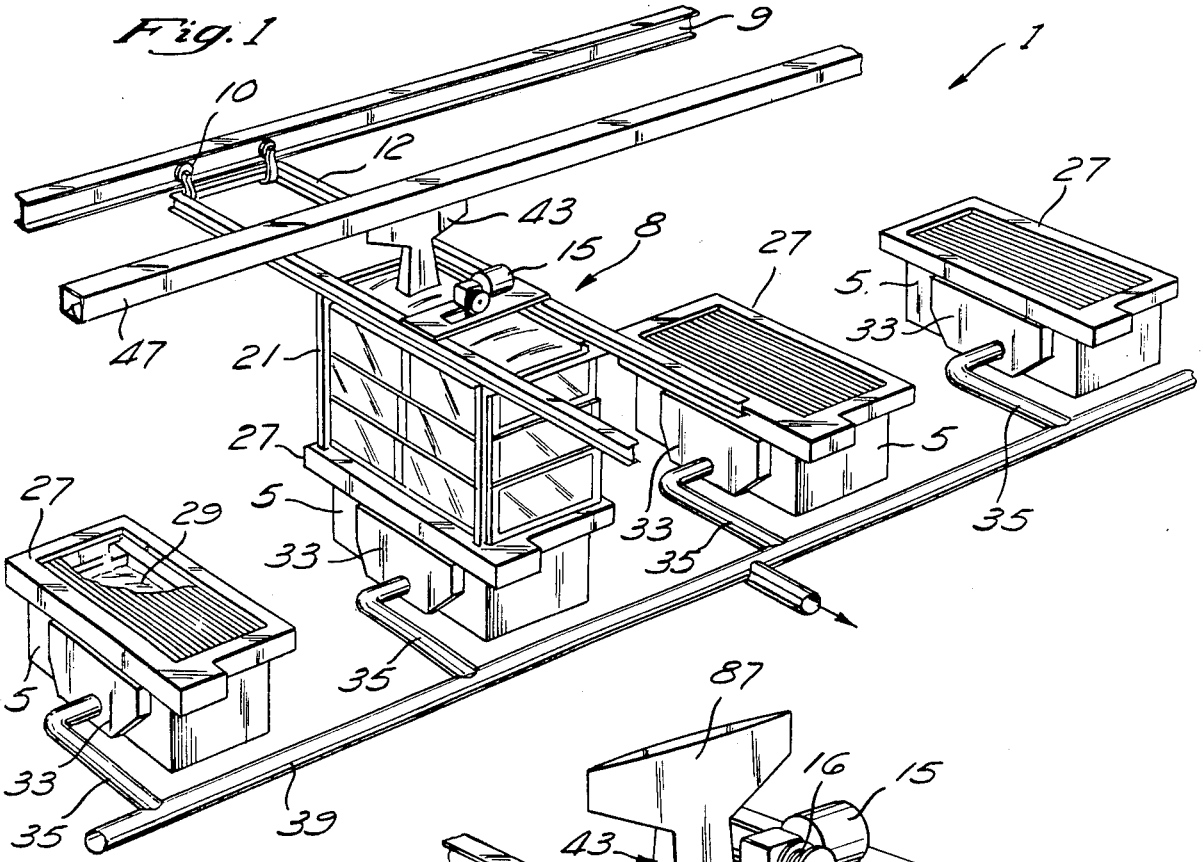
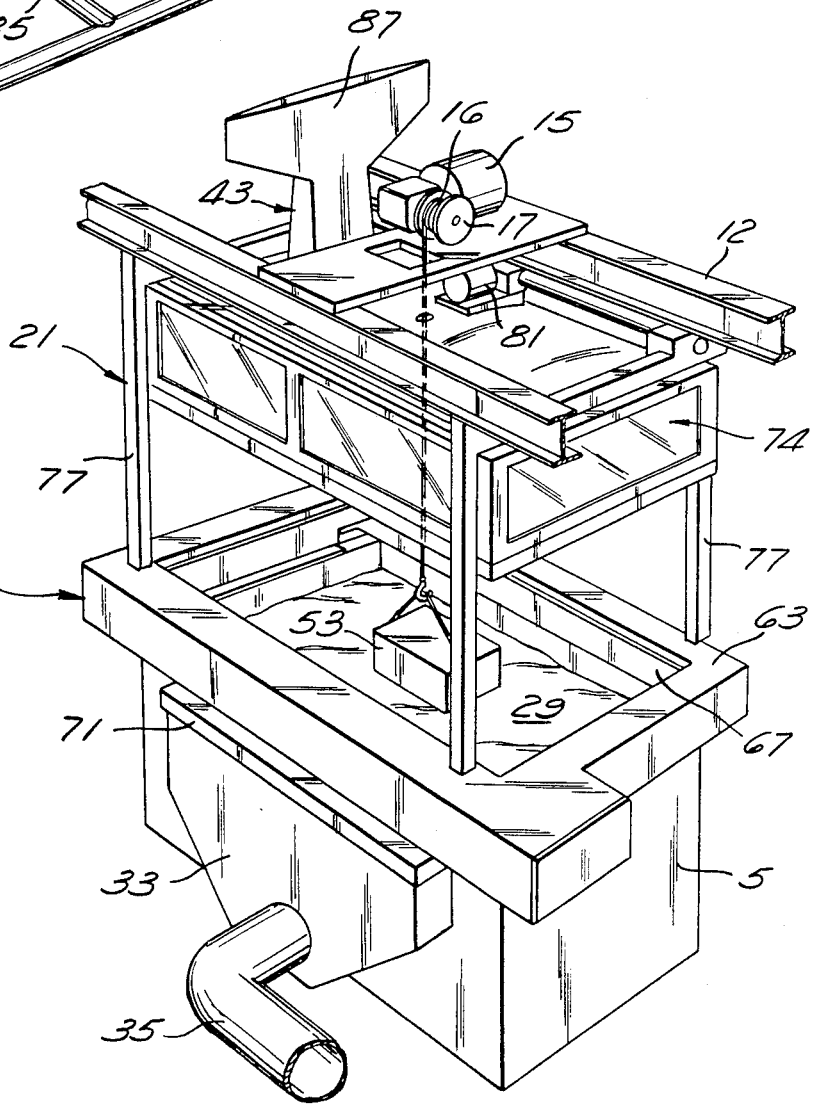
Fig. 2

Fig. 3
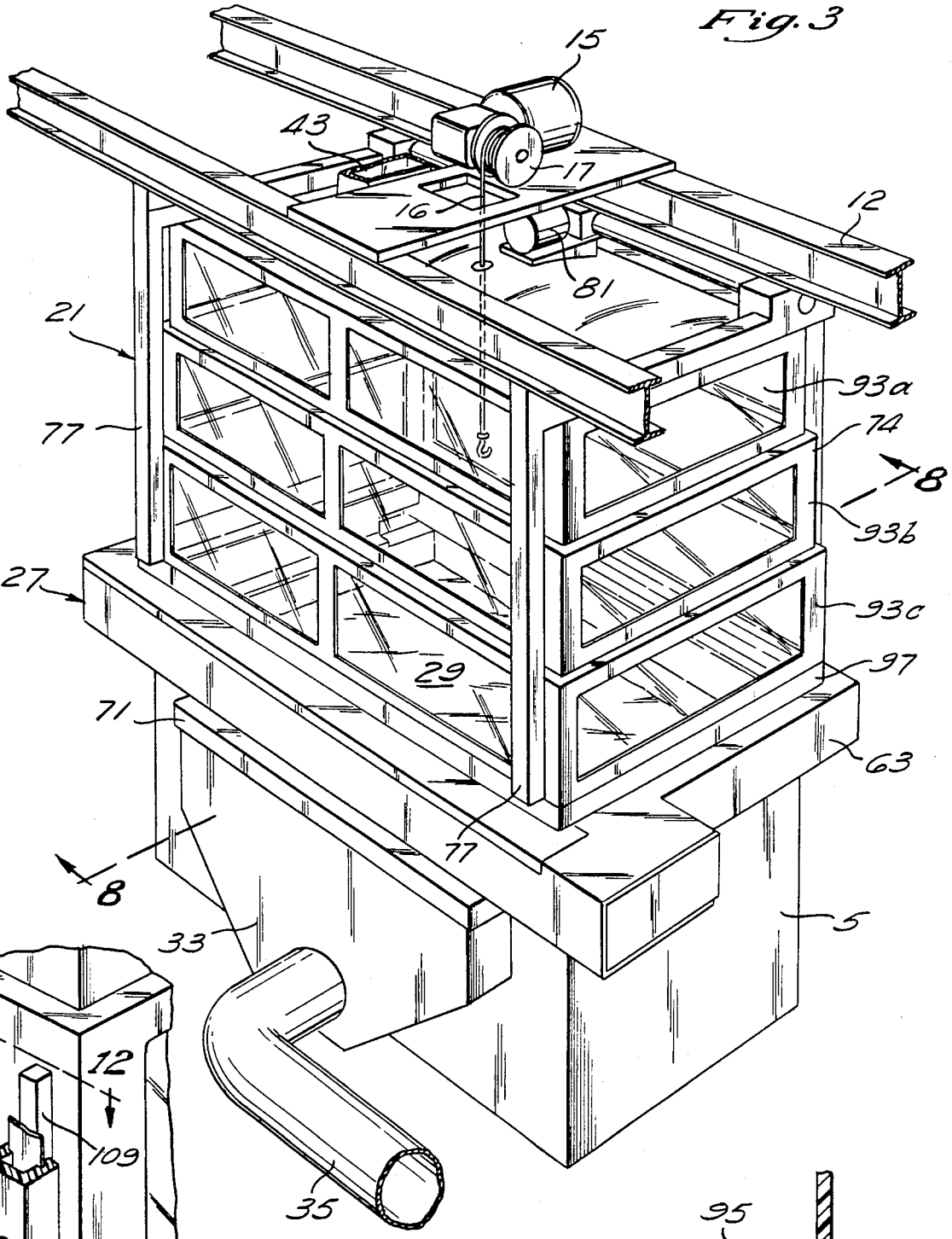
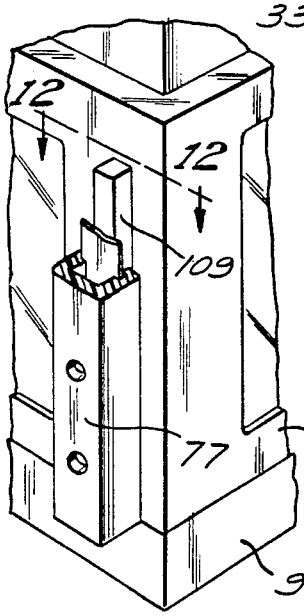
Fig. 11
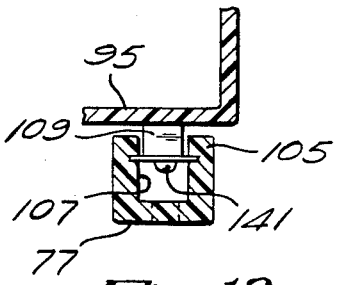
Fig. 12

Fig. 5
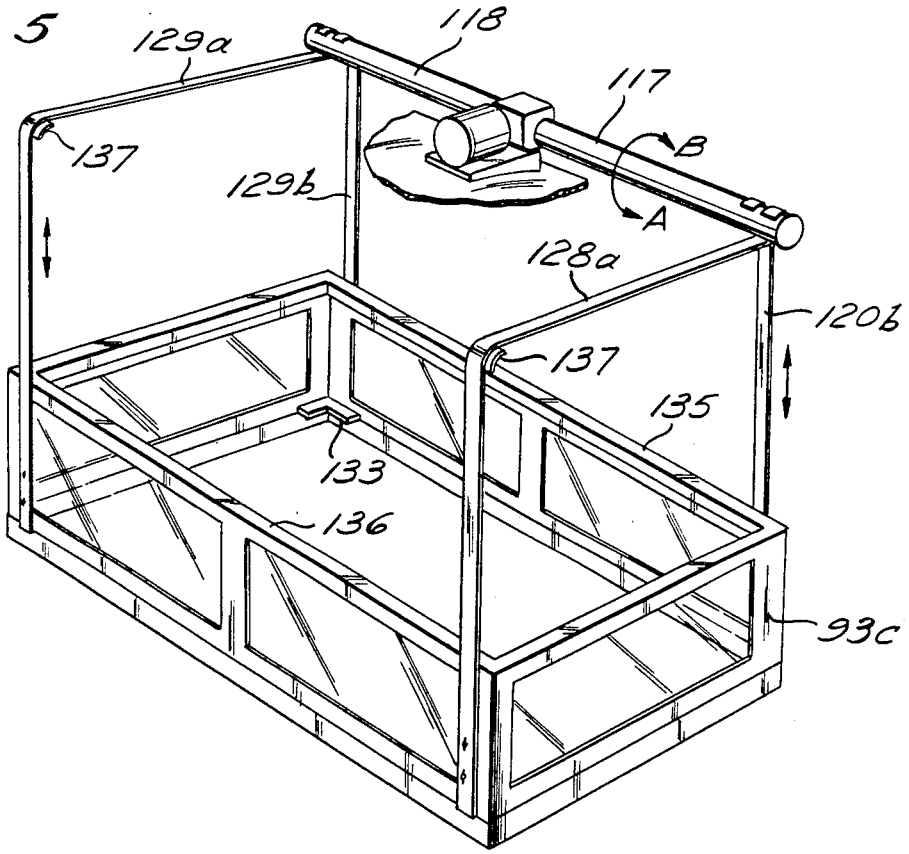
Fig. 6
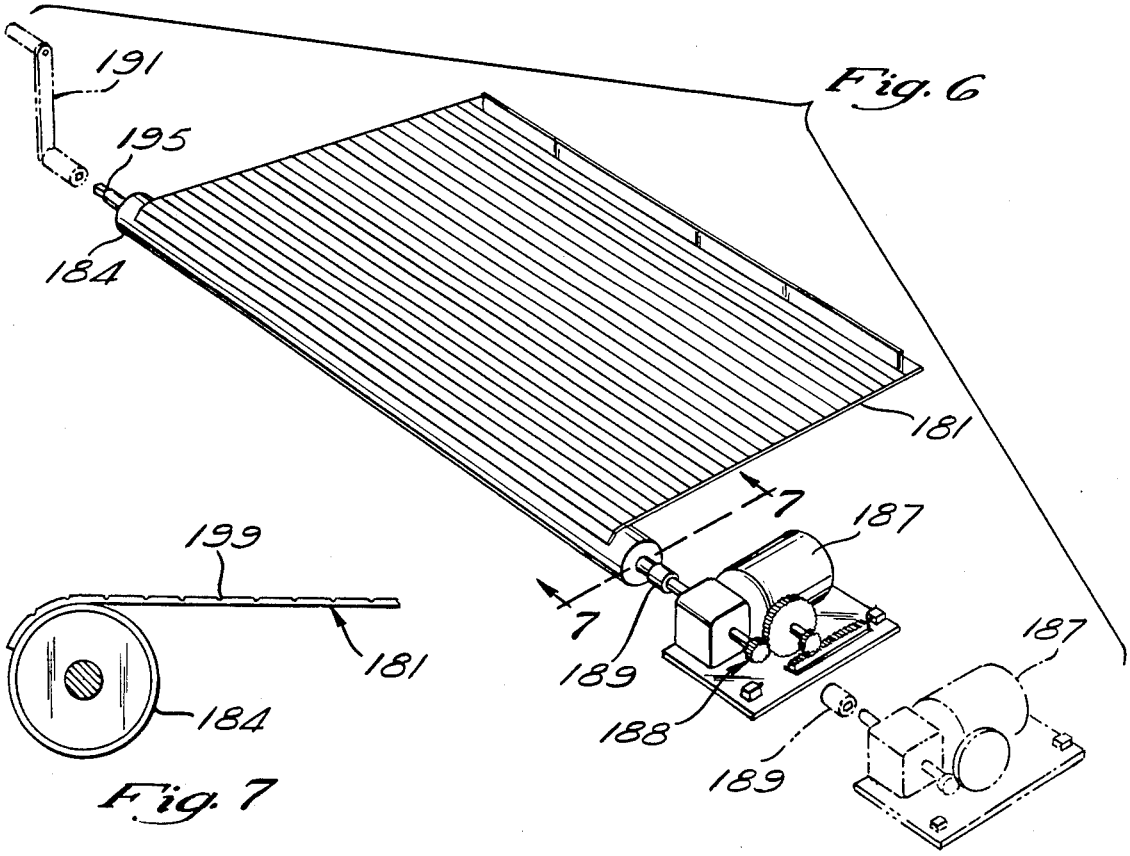
Fig. 7

INDUSTRIAL EXHAUST VENTILATION SYSTEM

BACKGROUND OF THE INVENTION

1. Field of the Invention

The present invention relates to ventilation systems, and more particularly to such systems as are used in industrial settings to contain and exhaust harmful or unwanted gaseous bi-products generated during various types of manufacturing processes. Although the present invention may be used in a wide variety of industrial settings, it is particularly suited for use in the chemical processing of metals.

2. Description of the Prior Art

Many industrial processes generate fumes and gases that are environmentally harmful—both to the surrounding physical plant and to the operating personnel. This is particularly true in the chemical processing of metals. Large vats of especially noxious solutions are used in a variety of processes ranging from the simple metal cleaning and pickling operations to the sophisticated chem-milling, anodizing, and metal plating treatments. These processes normally require a number of separate treating tanks, with the metal workpiece being moved from one tank to the next as the reaction proceeds. To permit easy access to the processing solution for the insertion and removal of the workpiece, all of these tanks have traditionally remained uncovered, with fumes being generated over the entire surface of the solution. In addition, many of the reactant tanks are heated to speed the chemical reactions, thereby generating even larger quantities of fumes upon the insertion of the workpiece into the tank. Thereafter, removal of the workpiece provides additional quantities of fumes as the heated liquid rapidly evaporates from the now-treated (and hot) workpiece. In addition to these peak times of fume generation, there is always the steady-state problem of fumes leaving the open tanks during the 90% of the time that the heated tank is not being used as part of a chemical processing step.

If left unrestrained and/or uncaptured, the saturated, heated fumes are a potentially deadly health hazard to plant personnel, with almost certain long-term exposure risks. Further, these fumes will eventually destroy all of the structural members in the manufacturing facility with which they come into contact. These solutions are, in fact, so corrosive that structural concrete rapidly ages to powder.

The health and labor codes enacted early this century encouraged industry to capture and control these toxic fumes. Since ready access to the tank solution is required during operation, the conventional systems made use of high volume, negative pressure collection hoods located adjacent to the tank. In most cases, these collector hoods were placed opposite one another on the top edge of the chemical tanks.

Developed from the fine-particulate collection methods, sufficient air was to be pulled through the ventilation hoods that, in theory, would capture all fumes escaping from the tank surface. This system, inefficient at best, was impractical for tanks having widths of greater than four feet. For the wider tanks, one of the pair of suction hoods was converted into a forced-air ventilator, with air blown from the hood, across the liquid surface, and into the corresponding exhaust hood. These latter systems, referred to as push-air systems, had the same air circulation entrainment problems of the conventional system, only exacerbated by the positive or forced air flow across the tank surface. Thermals created by the hot liquid tended to deflect the pushed air stream in an upward manner, frequently to a sufficient extent that a significant portion of the pushed air "escaped" over the exhaust hood and out into the surrounding environment. A second problem occurred each time that a workpiece was lowered or raised from the liquid surface. The workpiece acted as an air baffle, causing the pushed air to be randomly deflected—thereby again missing the exhaust hood and being discharged, saturated with fumes, into the surrounding air.

Aside from the practical problem that these systems are not effective "collectors" of fumes, their greatest disadvantages relates to the extremely high volume of air flow necessary to achieve even the most minimal standard levels of fume capture levels. Extremely large amounts of power are required to physically move the enormous quantities of air in circulation through the system. Further, like in any closed circulation system, the removed air also represents a large amount of lost thermal energy to the system, which must be replaced if the processing is to efficiently continue. The replacement air must be either heated or cooled to the appropriate temperature, and heat energy lost from the processing solutions must also be replaced.

In an effort to reduce this large energy demand, various structures have been suggested. As shown in the published United Kingdom Patent Application, No. GB 2,077,419A (published Dec. 16, 1981), a hood or cover plate is provided that lowers over and partly covers the tank surface during an electroplating operation. However, as previously mentioned, a tank is typically in "operation" less than 10% of the time. The '419 United Kingdom application does not address this problem.

A totally enclosed tank would eliminate all emission problems, however the tank must also be enclosed in a manner that permits ready access to the treating solution by the workpiece. The Madwed patent (U.S. Pat. No. 3,106,927) discloses the use of a vapor-condensing chamber 10 enclosed on all sides except for an open bottom. The chamber sits over the treatment tank and accepts a workpiece through access and exit doors formed in side walls of the chamber 10. Air curtains are also provided to reduce fume emissions when the doors are open. This Madwed device functions in many ways as an "air lock", and its semi-permanent mounting greatly reduces the versatility of the process line, since it is designed to accept workpieces from a certain previous location, in Madwed, the workpieces are conveyed to the air lock from a specific previous location on a straight-line conveyor system.

The majority of chemical process installations make use of craneway and/or monorail hoist mechanisms to convey the workloads to and from the treatment tanks. These hoists provide great freedom with respect to providing access to treatment tanks in a random sequential manner (depending upon the process treatment required) regardless of the immediate proximity of the selected processing tanks to one another. The fixed-line conveyance system required by the Madwed device does not provide such freedom. The Barton patent (U.S. Pat. No. 3,444,802) replaces the doors of Madwed with intense, downwardly directed air streams, and mounts the unit on a hoist. The workpiece is raised and lowered while remaining within an "enclosure" formed by side wall plates 37 and the two downwardly directed air curtains. The Vauriac patent (U.S. Pat. No.

3,567,614) provides a similar device, for a slightly different purpose. To protect the workpiece transfer machinery from the chemical fumes, Vauriac teaches the use of an enclosed, part-holding hoist that is provided with positive internal air pressure to prevent the fumes from entering into the enclosed apparatus. Collection of the emanating fumes is left to conventional exhaust systems.

The great mobility provided by hoists has created difficulties when attempting to make modifications in the conventional exhaust systems. The adjustable hoods of the type shown by Rosenak (U.S. Pat. No. 3,205,810) are not practical where a craneway is operating. The Zalkind patent (U.S. Pat. No. 2,939,378) attempts to solve this mobility problem by permitting the ducts to move up and out of the way when a crane must travel through. Connecting the exhaust ventilation system to the hoist ensures that the ventilation system will be where needed, which is adjacent to the workpiece. However, this solution requires a non-conventional type of connection linking the hoist duct to the central exhaust ventilating system.

Although not disclosed in great detail, Vauriac does teach one possible mechanism for providing such a flexible connection, ensuring adequate positive air pressure within the Vauriac enclosed hoist mechanism. The Ludscheidt patent (U.S. Pat. No. 4,389,923) utilizes an elongate stationary duct connected to a hose by displaceable sealing elements. The sealing elements are linked together to sequentially move in an up and down manner and thereby permit passage of the hose while maintaining the seal. A less complex mechanism is proposed by the Naevestad patent (U.S. Pat. No. 4,087,333) wherein a quench car used in coke production is provided with a traveling hood. The top of the hood narrows into an elongate neck, which in turn projects into a slotted exhaust duct. Parallel flexible sealing strips seal the duct around the elongate neck, permitting the neck to laterally move along the slotted duct.

None of the foregoing devices have achieved an adequate solution to the problem of controlling and capturing emissions generated during the chemical processing of metals, or other multi-step chemical processes where mobility of the workpiece is required. Previous attempts have not been able to resolve the conflict between providing a sealing structure that physically contains the generated fumes in a more "positive" manner than by an air curtain, yet permitting the workpiece to be randomly moved to any number of work stations, maintaining the seal integrity at each station.

SUMMARY OF THE INVENTION

The present invention has as an underlying objective the improvement in the heretofore-known types of exhaust ventilation systems used in conjunction with chemical processes employing hoist mechanisms for conveyance of work loads, by the provision of two separate exhaust hood systems that interact in a manner that provides total control over the generated fumes.

This goal is inventably achieved by providing a reciprocating tank cover apparatus that encloses virtually the entire tank surface during periods of inactivity and/or when a given work load is in residence. The second system consists of a traveling exhaust work load enclosure that is mounted to and travels with the hoist mechanism. The hoist enclosure consists of a top canopy with an attached transparent curtain that forms the four lateral sides, surrounding the work load. The enclosure remains open at the bottom to permit the raising and lowering of the work load into the process tanks. In an alternate embodiment, the work load enclosure can also be provided with an exhaust duct ventilation system that is mounted on and travels with the hoist enclosure. The exhaust duct is attached to the main exhaust manifold through a slotted duct plenum. When in operation, the reciprocating tank cover remains closed over the process tank until a workpiece is ready for placement therein. The workpiece is brought to the selected tank by the hoist mechanism, surrounded by the work load enclosure. When in position over the tank, a sealing strop on the work load enclosure makes contact with the upper portion of the tank cover, creating an isolated processing tank/work load environment. The tank cover is then opened, the work piece lowered, and the hoist can either remain in position over that tank until the process is completed, or the hoist can readily be moved away to be used with another workpiece. In the latter event, the tank cover closes until the work load enclosure returns. Under this inventive system, the processing tanks never remain open in an unrestricted manner. The tank cover is either closed or, when it is opened, the work load enclosure lies thereabove, sealing the unit from the surrounding environment.

The reciprocating tank cover apparatus consists of an outer frame attached to the process tank with a central opening formed therein to correspond in size and shape with the process tank opening. The outer frame also has passageways included therein to conduct the various heating pipes and controls necessary to operate the process tank. Openings are also provided adjacent to the tank surface, forming the exhaust duct openings for a conventional negative ventilation system to vent the fumes from above the surface of the processing solution.

In addition to the outer frame, the tank cover apparatus is provided with a moveable cover assembly that can be selectively extended or retracted to cover or uncover the process tank. As discussed previously, such chemical processing tanks are frequently not in use over 90% of the time. During this entire period, fumes are constantly being produced from the heated liquid, and by utilizing the tank cover according to the present invention, the effective exposed surface area of the process liquid is significantly reduced. Although the tank cover apparatus utilizes a conventional negative pressure, exhaust ventilation system, the volume of exhaust air can be greatly reduced due to the large reduction in the effective liquid surface area that remains "exposed" when the tank is covered.

Cooperating with the tank cover is an entirely separate and independent construction that is attached to and encloses the hoist mechanism. This structure consists of a top canopy with all four sides completely sealed by a transparent curtain. No bottom to the hoist enclosure is provided, and access to the workpiece may be had either through the open bottom or, in one embodiment, by providing a transparent curtain that may be raised towards the top canopy. In such an embodiment, the curtain could be raised to provide access to the workpiece, either to mount it on or remove it from the hoist mechanism, or to adjust it should the workpiece shift at some point during the chemical process. Otherwise, the curtain remains in its fully extended position to maintain the enclosure formed above the process tank, the enclosure consisting of the outer frame for the tank cover, the transparent curtain, and the top canopy.

For smaller systems, there is sufficient air flow generated by the ventilation ducts within the outer tank cover frame to evacuate the hoist work load enclosure. However for the larger applications, it is desirable to provide the hoist work load enclosure with a separate exhaust duct formed in the top canopy. This exhaust duct will travel with the hoist enclosure on the craneway, providing exhaust ventilation of the enclosure by conveying any process fumes from the enclosure, through a connecting plenum, and into the main exhaust manifold.

By employing two cooperating but independent ventilation systems, the present invention provides an industrial exhaust system that requires much less energy to operate due to its effective reduction in the amount of fume-generating surface area. Under the present invention, the entire surface of the process tank is never directly exposed to the environment. Except when a workpiece is being added or removed from the process tank, the tank cover is in place. The conventional ventilation system used with the tank cover assembly removes the fumes that are effectively generated by only a fraction of the tank surface area. When it is necessary to add or remove a workpiece, and thus the tank cover must be open, the hoist enclosure will always be in placed. The saturated fumes generated within the enclosed area thus created are removed by the conventional ventilation system within the tank cover frame assembly, and, optionally, an exhaust duct in the top canopy of the hoist enclosure. After the workpiece has been placed in or removed from the process tank, the tank cover closes, and the hoist enclosure and hoist mechanism may freely move to another process tank. Any fumes being generated by the evaporation from a treated workpiece will remain within this hoist enclosure. Evacuation may occur through a duct formed in the top canopy, or by the conventional exhaust system located in the tank cover framework of the succeeding process tank.

Various other objects, advantages, and features of the present invention will become readily apparent from the ensuing detailed description, and the novel features will be particularly pointed out in the appended claims.

BRIEF DESCRIPTION OF THE DRAWINGS

FIG. 1 is a perspective view showing a hoist line chemical process having an industrial exhaust ventilation system according to the present invention;

FIG. 2 is a perspective view, similar to FIG. 1, showing an individual chemical processing tank having an exhaust ventilation system according to the present invention;

FIG. 3 is an enlarged perspective view similar to FIG. 2, showing an individual chemical processing tank having an exhaust ventilation system according to the present invention;

FIG. 5 is a partial perspective view showing portions of a traveling exhaust workload enclosure, particularly the mechanism used to raise and lower a canopy thereof;

FIG. 6 is a partial perspective view showing a cover and alternate drive mechanisms for the processing tank according to the present invention, with the hand-operational mechanisms shown in phantom;

FIG. 7 is a partial side elevational view taken substantially along the line 7—7 of FIG. 6, showing the cover for the processing tank assembly shown attached to a cover take-up shaft according to the present invention;

FIG. 11 is a partial perspective view, with portions in section and portions broken away, showing the attachment of the drive strap for the transparent workload enclosure as attached to a lower frame of the canopy;

FIG. 12 is a sectional view taken substantially along the line 12—12 of FIG. 11, showing the attachment of the flexible drive strap to a lower frame of the canopy according to the present invention;

DESCRIPTION OF THE PREFERRED EMBODIMENT

Figure 4:
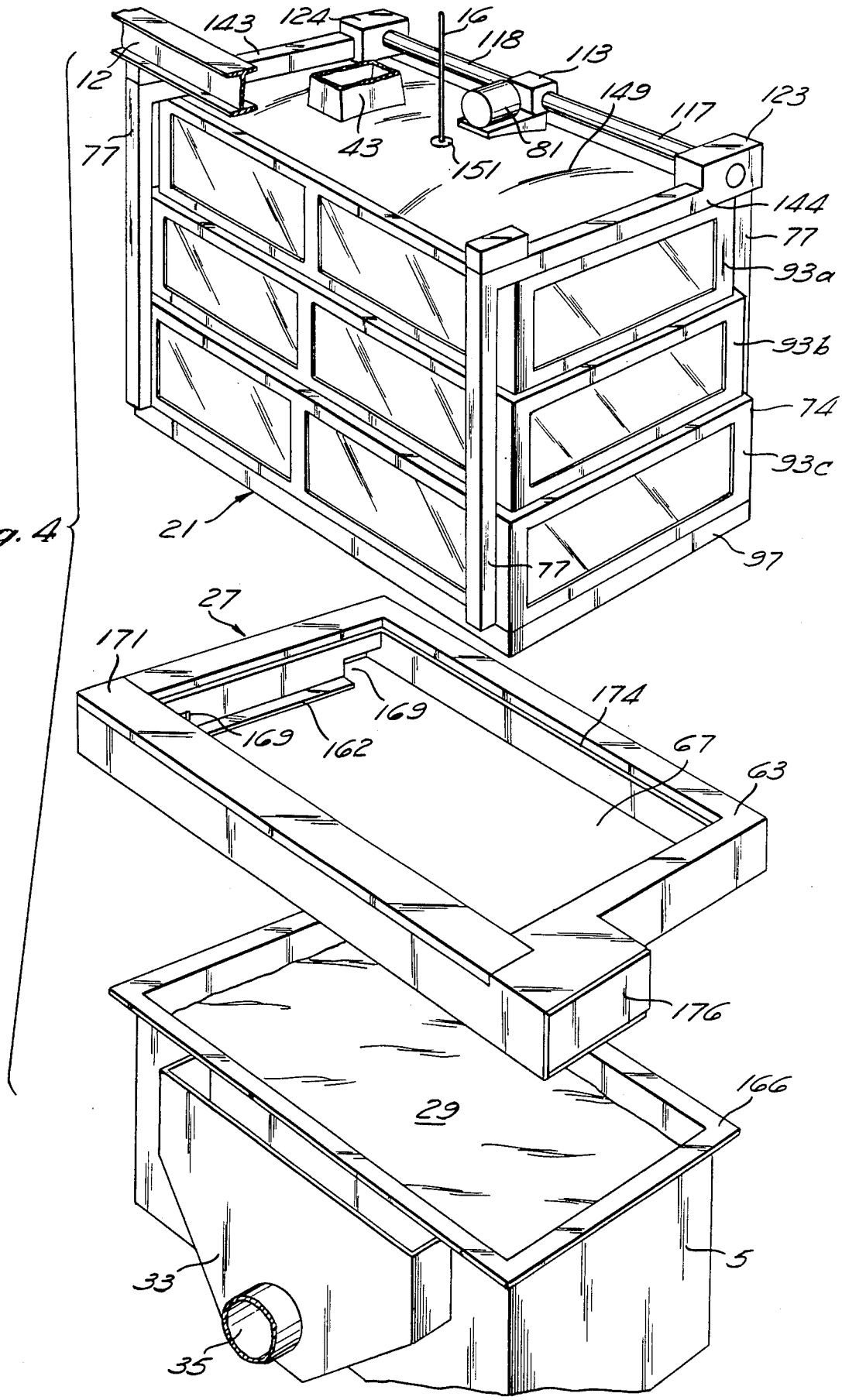
FIG. 4 is an exploded perspective view showing an individual chemical processing tank having an exhaust ventilation system according to the present invention.

FIG. 1 shows a hoist line 1 of the type used in a wide variety of different chemical processes, including chemmilling, anodizing, metal plating, metal cleaning, and pickling operations. These types of processes typically require several separate stages to accomplish the needed chemical reactions, and a plurality of separate processing tanks 5 are normally employed. Although it is possible to move the treated metal from tank to tank by hand, it is normally done using a craneway hoist 8. One or more hoist support rails 9 (only one shown) are provided to create a traveling pathway, with the craneway hoist 8 mounted on a plurality of track wheels 10 to provide easy access to each of the processing tanks 5.

The craneway hoist 8 is suspended from the hoist support rail 9 on a hoist frame 12. A hoist motor 15 is provided on the hoist frame 12, and is used to raise and lower the materials to be processed into and out of the various processing tanks 5 utilizing a hoist line 16 attached to a hoist reel 17 (shown in FIG. 2). In the hoist line 1 according to the present invention, a workload enclosure 21 is attached to and suspended from the hoist frame 12. The workload enclosure 21 creates a fume containment region surrounding the material that is being treated and carried from tank to tank with the craneway hoist 8.

As shown in FIG. 1, the craneway hoist 8 is positioned over one of the processing tanks 5, with a reciprocating cover assembly 27 shown between the processing tank 5 and the workload enclosure 21. The cover assembly 27, as shown more fully in the remaining processing tanks 5 shown in FIG. 1, is a separate part of the present inventive exhaust ventilation system, providing a cover for the processing tanks 5 when the material being treated is not being placed in or withdrawn from the processing tanks 5. Each of the tanks 5 is provided with a processing solution 29 consisting of the various reagents required to obtain the chemical reactions necessary to accomplish the particular treatment. Many of the processing solutions 29 are noxious, acidic or caustic materials that generate equally noxious fumes. Many of the chemical reactions that occur during the treatment process require the processing solutions 29 to be heated, in turn greatly increasing the amount of fumes that would otherwise be generated. The reciprocating cover assemblies 27 dramatically reduce the amount of surface area of the process solution 29 that is exposed to the surrounding work environment.

The conventional exhaust ventilation systems attempt to control the fume problem by brute force, generating an intense air flow over the processing tanks 5 in an effort to capture all of the fumes given off by the tank, entraining those fumes in the air stream for eventual treatment elsewhere. By reducing the effective amount of exposed surface area of the processing solution 29, the reciprocating cover assembly 27 dramatically reduces the amount of air flow necessary to establish a containing air flow circulation system.

Whether utilizing a conventional system, or the present inventive embodiment, the entrained fumes are removed from the processing tanks 5 through one or more Clateral exhaust hoods 33 located adjacent to the surface of the processing solution 29. From the exhaust hoods 33, the air stream passes through an exhaust pipe 35 and into an exhaust collector 39, the collector 39 receiving the exhaust air from a number of different processing tanks 5.

Although not necessary to the practice of the present invention, the embodiment shown in FIG. 1 also provides for collecting exhaust air from within the workload enclosure 21. An upper exhaust connecting conduit 43 is provided to form an air passageway between the interior portion of the workload 21 and the slotted exhaust duct 47. Air flows from within the workload enclosure 21, through the connecting conduit 43 and into the slotted exhaust duct 47. Air is discharged from the slotted duct 47 into a main exhaust manifold (not shown). When using such an embodiment according to the present invention, an exhaust air stream for containment and control of fumes is generated by air flowing through the lateral exhaust hoods 33 and an exhaust air stream flowing from the workload enclosure 21 through the connecting conduit 43.

Additional structural details of the workload enclosure 21, and of the entire inventive exhaust ventilation system are shown in FIG. 2, with a workload 53 shown attached to the hoist motor 15, and suspended over the processing solution 29. As shown by FIG. 2, the cover assembly 27 consists of an outer cover frame 63 that surrounds and forms a central opening 67. The workload 53 is provided access to the processing solution 29 through the central opening 67. The outer cover frame 63 is received by and rests upon the processing tank 5. When the cover assembly 27 does not form an integral unit with the processing tank 5, as is the case when being retrofitted to an existing hoist line system, an exhaust spacer conduit 71 may be used to connect the lateral exhaust hoods 33 to one or more exhaust openings 73 (see FIG. 8) formed in the cover frame 63. The materials used to fabricate both the cover assembly 27 and the workload enclosure 21 may include any of various materials able to withstand attack by the processing solutions. Such materials as stainless steel, PVC, fiberglass, and the like corrosion-resistant materials are appropriate, however a preferred material is polypropylene thickness varying from $\frac{1}{8}''$ to $\frac{3}{4}''$, as manufactured by Dynamit Nobel.

FIG. 2 illustrates a second operating position of the workload enclosure 21. Where it is necessary to obtain access to the workload 53, for example to initially load it on the hoist mechanism, or should the workload 53 shift during the treatment process, a movable canopy 74 is installed on a plurality of canopy support posts 77. When the canopy 74 is in its fully extended position, as is shown in FIG. 1, the workload enclosure 21 fully contains all fumes being generated by the processing tank 5 located below the craneway hoist 8. When in its fully retracted position, as shown in FIG. 2, access to the workload 53 is provided. A canopy motor 81 is provided to extend and retract the canopy 74. The motor 81 may conveniently be any type of rotating motor system, including pneumatic and conventional electric motors. A particularly advantageous motor is fractional horse power electric motor of the type manufactured by W. W. Granger. As mentioned previously, fumes from the workload enclosure 21 are conveyed into the slotted exhaust duct 47 through the connecting conduit 43. As shown in FIG. 2, the connecting conduit 43 is provided with a canoe-shaped discharge duct 87, of a size suitable for entry of the connecting conduit 43 in the slotted duct 47. The connecting conduit 43 may also be constructed out of polypropylene, fiberglass, or the previously listed corrosion-resistant materials.

Figure 8:
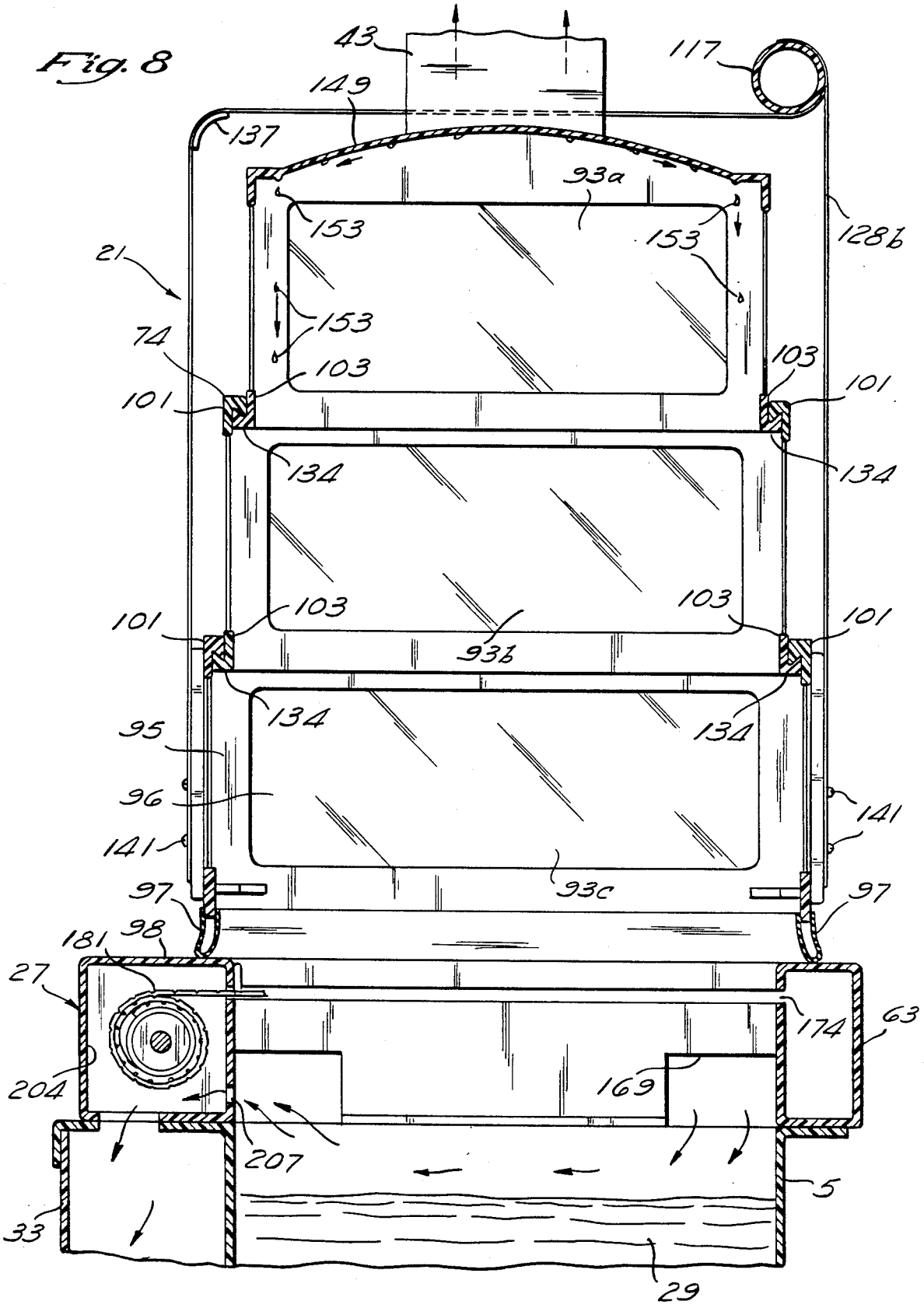
FIG. 8 is side elevational view in irregular section taken substantially along the line 8—8 of FIG. 3, showing a chemical processing tank equipped with an industrial exhaust ventilation system according to the present invention.

The extended position of the canopy 74 is perhaps better shown by FIG. 3. The canopy 74 consists of a plurality of separate window sections **93*a*, 93*b*, 93*c*, and in the extended position, the window sections 93*a*, 93*b*, 93*c* hang from one another forming sealed relationships therebetween. Referring momentarily to FIG. 8, each of the window sections 93*a*, 93*b*, 93*c*, consist of a support frame 95 that surrounds and receives a transparent pane 96. The support frames may conveniently be fabricated our of polypropylene or any of the previously mentioned corrosion resistant materials, and the transparent panes 96 may suitably be acrylic. The upper and lower portions of the support frame 95 form an upper sealing strip 101 and a lower sealing strip 103 that, when the canopy 74 is in its fully extended position, interengage with one another as shown in FIG. 8, forming a sealed interengagement between the window sections 93*a*, 93*b*, 93*c*. A canopy skirt is attached to the window section 93*c* that is adjacent the cover assembly 27 when the canopy 74 is in its fully extended position. The canopy skirt 97 is preferably constructed of a resilient material, and forms a temporary sealing interengagement between the canopy 74 and the top surface 98 of the outer cover frame 63. Neoprene is a preferred resilient material for the canopy skirt 97**.

FIGS. 4 and 5 illustrate the drive mechanism used to retract and extend the canopy 74 of the workload enclosure 21. The exposed portions of this drive mechanism are shown in FIG. 4, wherein the canopy motor 81 causes rotation to occur in the motor shaft (not shown), which in turn is translated within a gear box 113 to cause the rotation of a first canopy drive shaft 117 and a second canopy drive shaft 118. The first drive shaft 117 is supported at one end by the gear box 113 and at its other end by a first canopy journal box 123. Likewise, the second canopy drive shaft 118 is supported by the gear box 113 and at its other end by a second canopy journal box 124. Although the drive shafts may be fabricated out of any of the preceding, suitable materials, in an alternate embodiment, the drive shafts 117, 118 consists of a C PVC piping with an optional polyurethane foam filling. The pipe shaft is of the type supplied by Ryan-Herco, Burbank, Calif.

The rotational motion of the drive shafts 117, 118 are translated into linear motion to raise and lower the canopy 75 by one or more pairs of flexible strips, with one end of the strip attached to the rotating drive shaft and the other attached to the furthest extended window section. In the embodiment shown in FIG. 5, a first pair of flexible canopy strips 128*a*, 128*b* and a second pair of flexible canopy strips 129*a*, 129*b* are provided. These flexible canopy strips may be fabricated out of polypropylene having dimensions of 1½" wide by ⅛" thick for use with a workload enclosure. From the fully extended position of the canopy 74 shown in FIG. 5, rotation of the drive shafts 117, 118 in the direction shown by arrow A causes the attached flexible canopy strips 128, 129 to wind around and accumulate on the canopy drive shafts 117, 118. This effectively shortens the canopy strips 128, 129, which in turn causes the furthest extended window section 93*c* to begin to retract. At this point, the nested upper and lower sealing strips 101, 103, respectively, separate, with the upper sealing strip 101 riding along the outside of the adjacent window section 93*b* (not shown in FIG. 5) as the window section 93*c* retracts. A corner platform 133 is provided in each corner of all but the uppermost window section 93*a*. The corner platforms 133 (only one is shown in FIG. 5) are attached to the window section and move upwardly therewith as the canopy 74 is retracted. A bottom surface 134 of the lower sealing strip 103 (see FIG. 8) is received by the corner platform 133 as the lower, adjacent window section is retracting, thus nesting the second window section 93*b* within the outer, retracting window section 93*c*. Continued rotation of the drive shafts 117, 118 results in the two nested window sections continuing to retract as a unit, the upper sealing strip 101 of the second window unit thereafter breaking its sealing interengagement with the lower sealing strip of the upper, third window section 93*a*. Where more than three window sections are provided, this entire retraction process will repeat itself, the successive window units nesting inside one another, until the uppermost window unit 93*a* is reached. At this point, the canopy 74 is in its fully retracted position. Extension of the canopy 74 is merely the reverse of the foregoing process, with the drive shafts 117, 118 rotating according to arrow B, and the window units successively denesting as the canopy 74 extends.

As shown in FIG. 5, the drive shafts 117, 118 are substantially coplanar with a first lateral window section 135. This planar relationship enables the direct translation from the rotational movement of the drive shafts 117, 118 to the substantially linear, vertical motion of the flexible canopy strips 128*b*. Although it is possible to provide a second pair of drive shafts in a vertically coplanar relationship with a second lateral window section 136 to obtain this same rotational/linear translation, the same effect can be achieved by attached both canopy strips 128*a*, 128*b* to a single drive shaft, by providing a strip guide 137 that is coplanar with the second lateral window section 136, and thus translates the linear motion of the flexible canopy strip 128*a* into a substantially vertical linear motion. The flexible canopy strips 128, 129 may be attached to the furthest extended window section by any conventional attachment means, a plurality of strip attachment bolts 141 are shown as the attachment means in both FIGS. 5 and 8. These bolts may be fabricated out of type 304 stainless steel; some applications require type 316 stainless steel. A pathway for the flexible canopy strips 128, 129 (not shown) is provided within the canopy support post 77 and within a first and second upper lateral support frame 143, 144, respectively.

FIGS. 11 and 12 illustrate a preferred manner of attaching the flexible canopy strip 128 to the window section 93*c*. The flexible strip 128 is received by slots 105 formed on the interior walls 107 of the canopy support post 77. A strip retaining block 109 is attached to the window support frame 95 and the strip attachment bolt 141 passes through the strip 128 and is anchored in the retaining block 109.

In order to obtain air seals in the workload enclosure 21, it is necessary that the clearances and tolerances permitting movement between the various separate canopy members must be fairly precise. The forces being applied to the canopy members during retraction and extension must be substantially equally applied to each of the areas to prevent jamming from occurring. This can be accomplished by having the individual canopy members lowered and raised in a horizontally level manner, not permitting any one corner or corners to reach its extent of travel prior to the others. When using the flexible strips 128, these adjustments may readily be made in a conventional manner at the point where the flexible strips 128 are attached to the window section 93*c*. By utilizing slots formed in the flexible strips (not shown), in conjunction with the attachment bolts 141, it is possible to effect a lengthening or shortening of the flexible strip 128 with respect to the window section 93*c*.

A top canopy 149 overlies the canopy 74 and forms a sealed relationship therewith. The top canopy 149 and the canopy 74 together form the workload enclosure 21, with only the bottom open to permit the insertion and removal of the workpiece 53 into the processing solution 29. The hoist motor 15 lies above the top canopy 49, and a sealed opening 151 is formed in the top canopy 149 to permit passage of the hoist line 16.

In the preferred embodiment shown in FIG. 8, the top canopy 149 is formed as a half-dome. The air within the workload enclosure 21 frequently becomes saturated with fumes given off by the processing solution 29. Upon hitting the cooler, inner surfaces of the canopy 74 and the top canopy 149, condensation frequently occurs, producing a plurality of fume droplets 153. By providing the top canopy 149 with a half-dome shape, the fume droplets 153 will move outwardly, towards the canopy 74 prior to dropping back into the solution 29. This action prevents the fume droplets 153 from dropping directly onto the workpiece 53 located in the center of the workload enclosure 21. In the past, when the fume droplets 153 landed on the workload 53, it would frequently generate a chemical reaction at the point of impact on the metal, requiring the workload 53 to be returned to the initial process step and repeat the entire process. Such a result is substantially prevented by providing the top canopy 149 in a half-dome shape according to the present invention.

Returning to FIG. 4, the reciprocating cover assembly 27 is shown suspended between the workload enclosure 21 and the processing tank 5. When installed, the cover assembly 27 rests upon the processing tank 5, with at least one pair of mounting flanges 162 (only one shown) received by a lip 166 formed on the top walls of the processing tank 5. One or more equipment passages 169 are formed between the tank lip 166 and openings adjacent the corners in the outer cover frame 63. Two such openings are shown in the outer frame 63 depicted in FIG. 4. The equipment passages 169 are available to permit various types of pipe to be run into the tank for such things as heating, cooling, and supplying additional chemical reactants. The equipment passages 169 also enable outside air to flow into the contained area created by either or both the workload enclosure 21 and the reciprocating cover assembly 27 when the cover is fully extended.

An access cover 171 may be provided in the outer cover frame 63, to permit access to the cover and cover drive mechanisms. Similarly, a motor access panel 176 is provided in the outer cover frame 63, permitting rapid access to the cover drive motor (not shown in FIG. 4). A receiving slot 174 is formed in the interior walls of the outer cover frame 63, the receiving slot 174 guides the cover panels during their extension across the central opening of the cover assembly 27.

A cover 181, suitable for use with the cover assembly 27, is shown in FIG. 6. The cover 181 may be constructed out of many different types of materials, the key qualities for their present expected use include flexibility and the ease with which it can be extended or retracted during operation of the reciprocating cover assembly 27. For example, a number of telescoping sections consisting of fiberglass reinforced, plastic-covered polyurethane foam panels might be used as the cover 181. A suitable drive mechanism for such telescoping sections (not shown) are flexible strips of the type used with the canopy 74, attached to the leading section with the remaining sections linked together by flanges or the like.

As shown in FIG. 6, a preferred construction for the cover 181 consists of a single sheet of polypropylene with a linear scoring pattern providing the appearance of a plurality of separate slats. However, in the preferred embodiment, the scoring 199 is only to a sufficient depth to create a living or flexible hinge 99 (FIG. 7). The scoring 199 permits the polypropylene sheet to easily bend along the scoring line, greatly amplifying the flexibility of the polypropylene sheet. Flexibility of the cover 181 is desirable in order to permit the compact storage of the cover when in its retracted position, and to enable the extension thereof when required.

The cover 181 is taken up by and extended from a main cover shaft 184. The main shaft 184 is turned by a cover operating motor 187 that is located behind the motor access panel 176 (shown in FIG. 4). As shown in FIG. 6, the operating motor 187, through a system of gearing 188, rotates the main shaft 184 through a shaft linkage 189. In cases of motor or power failure, a hand crank 191 may be attached to a fail-safe fitting 195 formed on the main shaft 184 opposite to where the cover motor 187 is attached. In order to hand operate the system, it is necessary to disconnect the cover motor 187 from the main shaft 184, as shown in phantom in FIG. 6. Thereafter, the cover 181 can readily be manually operated—whether extended or retracted.

Returning to FIG. 8, the cover 181 is shown in its fully retracted position, lying within a cover storage chamber 204. In addition to providing room for the storage of the cover 181, the storage chamber 204 also provides a pathway for the exhaust air flow. Air leaves the processing tank 5 through a first exhaust opening 207 formed in an inner wall of the outer cover frame 63. After passing through the storage chamber 204, the air is exhausted through a second exhaust opening 211 formed in the outer cover frame 63 and in the spacer conduit 71. The conventional lateral exhaust hoods 33 are thereafter used to remove the exhaust gases. Replacement air is provided the system through the equipment passage 169.

Figure 9:
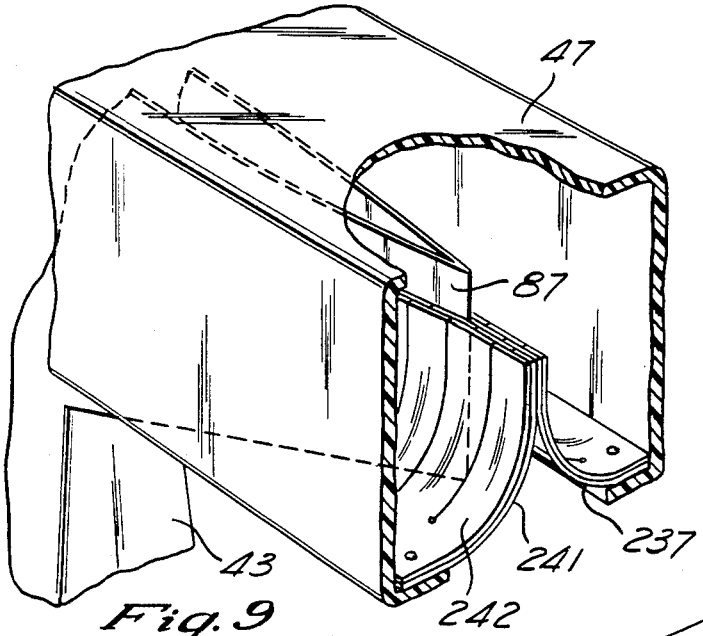
FIG. 9 is a perspective view with portions broken away showing an exhaust duct received by a slotted duct plenum according to the present invention, with portions of the exhaust duct shown in phantom.
Figure 10:
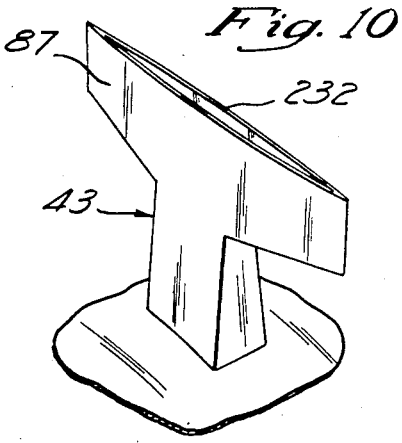
FIG. 10 is a partial perspective view showing a canoe-shaped exhaust duct as mounted on the traveling exhaust workload enclosure according to the present invention.

Although not necessary to practice the present invention, the workload enclosure 21 may be provided with a separate ventilation system besides that provided through the reciprocating cover assembly 27. Air and entrained fumes may flow through the upper exhaust connecting conduit 43 and into the slotted exhaust duct 47. As shown in FIG. 9, the slotted duct 47 receives the canoe-shaped discharge duct 87 through a slot-shaped opening 237 formed in the duct 47. An air seal is maintained about the discharge duct 87 through a sealing system consisting of an inner flexible boot 241, backed up by a plurality of curve-molded fingers 242. The flexible boot 241 may conveniently be formed of neoprene, and is forced together and/or against the sides of the canoe-shaped discharge duct 87 by the molded fingers 242, which can be conveniently formed from fiberglass reinforced plastic. When received by the slotted duct 47, the connecting conduit 43 permits passage of gases and entrained fumes from within the workload enclosure 21, through an opening 232 formed in the connecting conduit 43 (see FIG. 10), and into the slotted duct 47 for collection by a central exhaust manifold (not shown).

Figure 13:
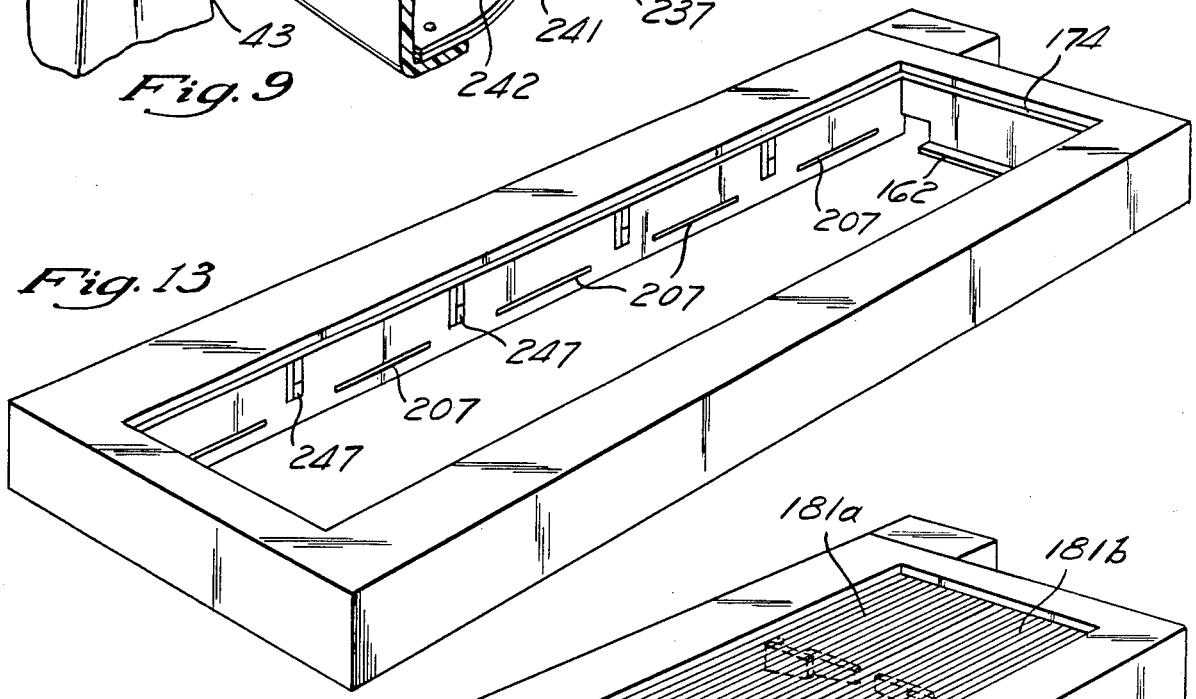
FIG. 13 is a perspective view showing an alternate embodiment of an outer frame for the process tank cover according to the present invention.
Figure 14:
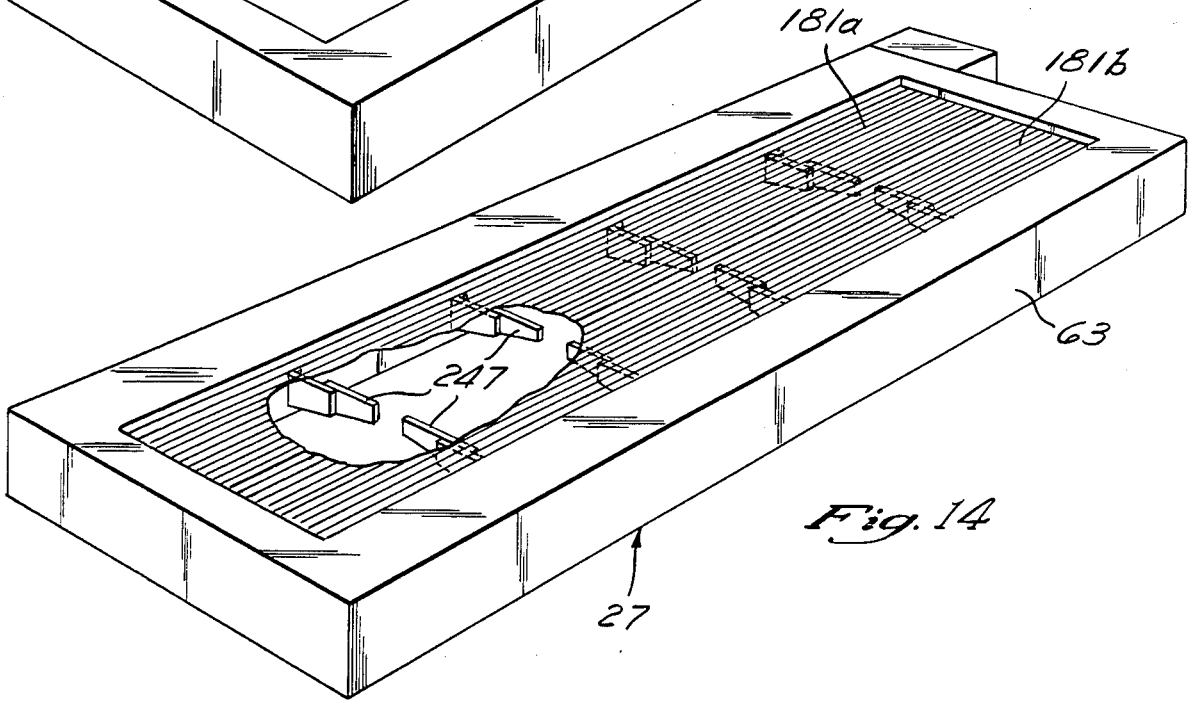
FIG. 14 is a perspective view similar to FIG. 13, showing an alternate embodiment of the process tank cover according to the present invention, with portions of the cover broken away to show cover support members, with other of said support members shown in phantom.

FIGS. 13 and 14 illustrate an alternate embodiment for the reciprocating cover assembly 27, where the processing tank 5 (not shown) is particularly large. For these larger tank openings, the cover receiving slot 174 no longer provides sufficient support to the cover 181 to prevent substantial sagging thereof, particularly towards the middle of the open tank area. This sagging risks not only damaging the cover 181, but also makes the extension and retraction thereof subject to hang-ups due to the binding of the cover 181 during its extension and retraction operations. For these larger processing tanks, a plurality of cover support rams 247 are provided, and simultaneously extend and retract in conjunction with the extending or retracting cover. In addition to the support rams 247, a pair of half covers **181*a*, 181*b* can be provided with the covers 181*a*, 181*b*** meeting substantially in the middle of the process opening.

While I have disclosed an exemplary structure to illustrate the principles of the present invention, it should be understood that I wish to embody within the scope of the patent warranted hereon, all such modifications as reasonably and properly come within the scope of my contribution to the art.

I claim:

1. An industrial ventilation system comprising:

a cover assembly having a reciprocating cover supported by an outer cover frame, said cover having a closed position and an open position and means for moving said cover between said open and closed position;

a source of industrial exhaust gases emanating from a structure that receives said reciprocating cover assembly, with said source of exhaust gases separated from the surrounding environment when said cover is in the closed position, and access to the source is provided when said cover is in the open position;

at least one exhaust opening formed in said outer cover frame, said exhaust opening providing an air passageway for the industrial exhaust gases through said cover assembly regardless of the cover position;

an exhaust collector means communicating with said air passageway;

a workload enclosure received by said cover assembly, forming a fume containment region therewith when the reciprocating cover is in an open position;

means for moving said workload enclosure, permitting the selective engagement and disengagement of the enclosure with said cover assembly; and a hoist for carrying a workload attached to said workload enclosure in a manner wherein the workload is carried within and surrounded by the workload enclosure prior to the engagement of said workload enclosure with the cover assembly, whereby a workload can be brought to the cover assembly and thereafter lowered by the hoist through the open cover while simultaneously containing the exhaust gases within the fume containment region.

2. An industrial ventilation system as described in claim 1, and further comprising:

an exhaust discharge means attached to said workload enclosure and communicating with the interior portions thereof, whereby exhaust gases from the fume containment region may be exhausted through said exhaust discharge means.

* * * * *